US005931542A

United States Patent [19]

Britzke et al.

[11] Patent Number: 5,931,542

[45] Date of Patent: Aug. 3, 1999

[54] DEVICE AND METHOD FOR PREVENTING WEAR ON ROAD MILLING AND TRENCHING EQUIPMENT

[75] Inventors: Robert W. Britzke; H. Alan King, both of Rogers, Ark.

[73] Assignee: Rogers Tool Works, Inc., Rogers, Ark.

[21] Appl. No.: 08/828,173

[22] Filed: Mar. 18, 1997

[51] Int. Cl.[6] ..... E21C 35/197

[52] U.S. Cl. ..... 299/104; 299/107

[58] Field of Search ..... 299/104, 106, 299/107

[56] References Cited

U.S. PATENT DOCUMENTS

| | | | |
|---|---|---|---|
| 4,489,986 | 12/1984 | Dziak | 299/104 |
| 4,561,698 | 12/1985 | Beebe | 299/104 |
| 4,660,890 | 4/1987 | Mills | 299/104 |
| 4,844,550 | 7/1989 | Beebe | 299/107 |
| 4,932,723 | 6/1990 | Mills | 299/104 |
| 5,098,167 | 3/1992 | Latham | 299/104 |
| 5,106,166 | 4/1992 | O'Neill | 299/104 |
| 5,273,343 | 12/1993 | Ojanen | 299/104 X |
| 5,415,462 | 5/1995 | Massa | 299/106 |

FOREIGN PATENT DOCUMENTS

| | | | |
|---|---|---|---|
| 2348446 | 4/1974 | Germany | 299/104 |

*Primary Examiner*—David J. Bagnell
*Attorney, Agent, or Firm*—Dickstein Shapiro Morin & Oshinsky LLP

[57] ABSTRACT

A wear prevention device for use with roadmilling or trenching machine blocks which hold rotatable cutting bits. The wear prevention device includes a substantially cylindrical retainer sleeve with a longitudinally directed slot running the length of the sleeve. The wear prevention device also includes a substantially circular wear washer with a radially inwardly directed key which is adapted to fit within the sleeve slot, thereby interlocking the sleeve and the wear washer. The retainer sleeve is adapted to receive a shank of a cutting bit and is placed within a bore in a machine block. The machine block bore may further include a keyway, or the machine block may include a boss surrounding the machine block bore with the keyway The retainer sleeve may further include a radially outwardly directed key adapted to fit within the machine block bore keyway, thereby further interlocking the retainer sleeve with the machine block.

5 Claims, 3 Drawing Sheets

DEVICE AND METHOD FOR PREVENTING WEAR ON ROAD MILLING AND TRENCHING EQUIPMENT

BACKGROUND

The present invention relates generally to roadmilling and trenching machine blocks and more particularly to a device and method for preventing wear on the face of roadmilling, trenching and other machine blocks that are used for retaining cutting bits.

Conventional roadmilling and trenching machines utilize cutting bits in normal operations. The cutting bits include a cutting surface located at an end of a cutting bit and a shank located at the other end of the cutting bit, and are rotated at rapid speeds. Means are provided to allow retention of the cutting bit shank within a bore of the machine block. In most instances, the cutting bit shank is retained within the bore by way of some form of retainer sleeve in combination with an enlarged end portion of the shank.

Due to rapid rotation of the cutting bit, excessive wear occurs on the face of the machine block into which the cutting bit shank extends. After prolonged use, the wear on the face of the machine block may become severe enough to require replacement of the machine block.

Several attempts have been made to alleviate the above noted problem. U.S. Pat. No. 4,561,698 (Beebe) refers to a sleeve and wear protector including an annular flange manufactured as a unitary wear protector. The unitary wear protector is manufactured of materials such that it wears at a rate substantially coincident with the wear rate of the cutting bit. However, Beebe is deficient in that the unitary construction of the wear protector requires replacement of the sleeve portion eventhough it may not be sufficiently worn to warrant replacement. Further, the unitary wear protector may rotate within the bore, thus leading to uneven wear of the protector assembly.

U.S. Pat. No. 4,489,986 (Dziak) refers to a retainer element mounted on a cylindrical shank of a cutter bit. The cutter bit is mounted within a bore of a block member. The shank fits within a retaining element which fits within a groove in the bore to prevent axial movement of the cutter bit. The block member includes a cylindrical portion upon which is mounted a wear collar. The cutter bit further has a shoulder which fits within the wear collar. Dziak fails to disclose a linkage between the wear collar, the retaining element and the block member.

It is, therefore, apparent that certain deficiencies exist in the conventional arrangement of roadmilling and trenching machines as regarding the retention of cutting bits therein.

SUMMARY

The present invention addresses and alleviates at least to some extent the deficiencies noted in conventional cutting bit retention arrangements. In particular, conventional arrangements for retaining cutting bits within a machine block bore do not address the problem of excessive wear on the face of the machine block.

The present invention relates generally to a device which protects machine blocks from excessive wear due to rapid rotation of cutting bits. More particularly, the present invention relates to a device for preventing wear made up of discrete components that are adapted to interlock, thus providing the added benefit of reducing the cost of replacing worn out wear elements.

A preferred embodiment of the wear prevention device of the present invention includes a substantially cylindrical retainer sleeve having a longitudinally directed slot. In addition, the wear prevention device of the present invention includes a substantially circular wear washer having a radially inwardly directed key. The wear washer further includes a centrally positioned opening through which the retainer sleeve may be positioned. The wear washer key is adapted to fit within the retainer sleeve slot, thereby interlocking the retainer sleeve with the wear washer. This provides the benefit of greatly reducing wear on the retainer sleeve.

The cutting bit shank is placed within the retainer sleeve which in turn is placed within the wear washer opening, allowing the wear washer key to interlock with the retainer sleeve. This entire arrangement is then placed within the machine block such that the retainer sleeve and cutting bit shank fit within a bore positioned in the machine block. The retainer sleeve original circumference may be such that it is marginally greater than the circumference of the machine block bore, thereby forcing the retainer sleeve slot walls to become biased toward one another in order to position the retainer sleeve within the machine block bore. This action may further lock the wear washer key within the retainer sleeve slot.

The wear prevention device of the present invention may further include means for interlocking the retainer sleeve to the machine block itself. The retainer sleeve may further include at one of its ends a key which is directed radially outwardly. Further, the machine block may further include a boss positioned on the machine block face and surrounding the machine block bore. The boss may include a keyway to receive the retainer sleeve key. By placing the retainer sleeve within the opening wear washer, interlocking the wear washer key with the retainer sleeve slot, and placing this arrangement within the machine block bore, the retainer sleeve key may be engaged within the machine block boss keyway, thus further interlocking the retainer sleeve to the machine block itself. This arrangement provides an added benefit of further diminishing the potential for wear on the retainer sleeve.

It is an object of the present invention to provide an inexpensive, effective wear prevention device which prevents excessive wear from occurring to the face of a machine block which receives and holds a rotating cutting bit.

It is a further object of the present invention to provide a method for preventing wear on the face of a machine which receives and holds a rotating cutting bit.

DETAILED DESCRIPTION OF PREFERRED EMBODIMENTS

FIGS. 1–6 are now referred to for the purpose of illustrating a preferred embodiment of and are not intended to limit the scope of the present invention.

Figure 1:
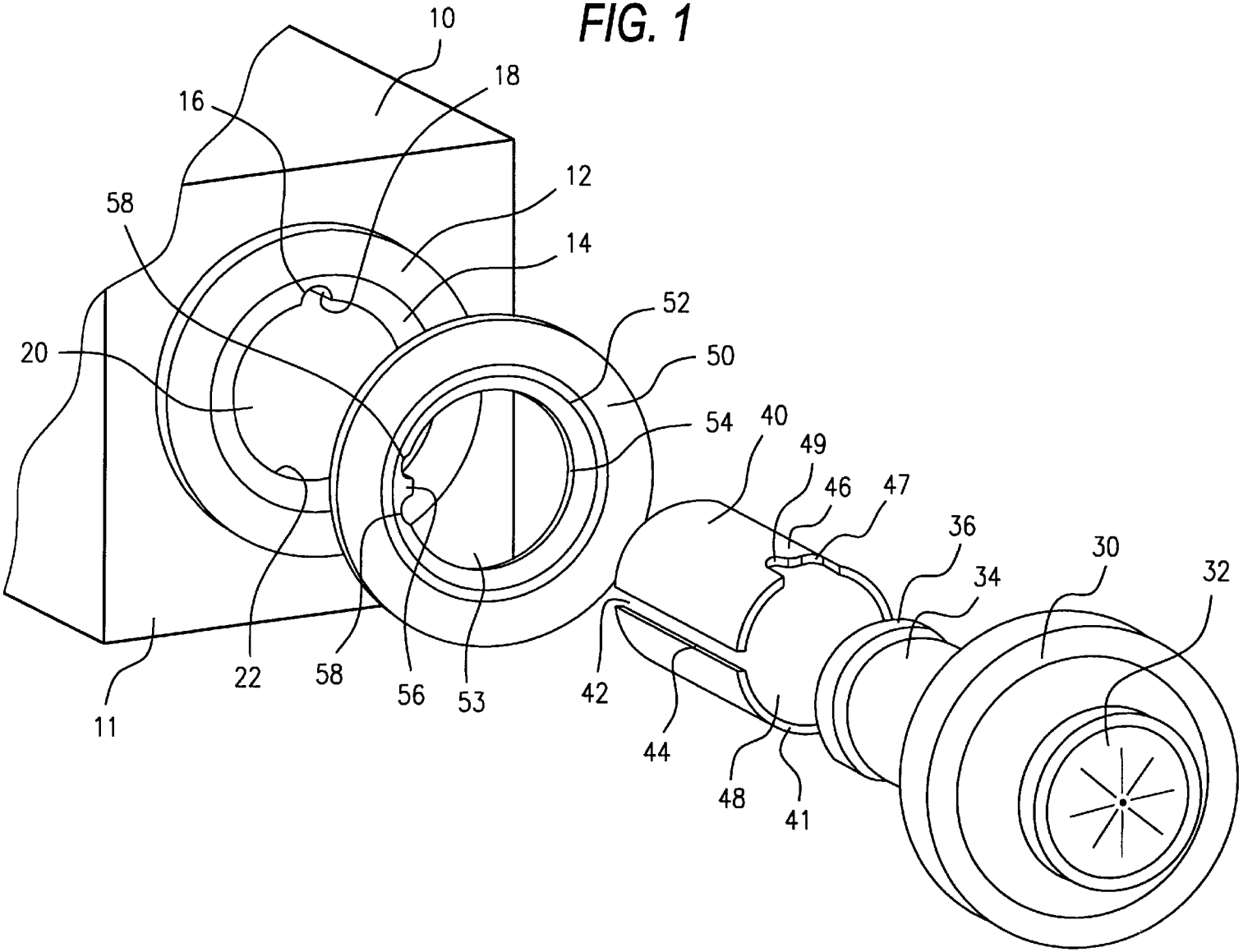
FIG. 1 is an exploded perspective view of a wear prevention device according to a preferred embodiment of the present invention.
Figure 2:
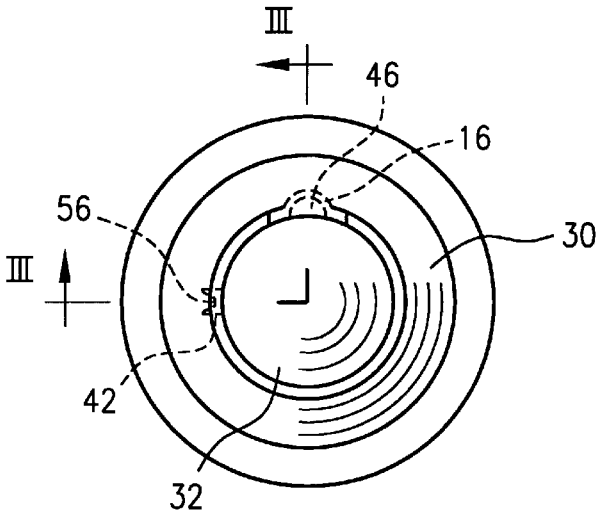
FIG. 2 is a view from the top of the wear prevention device of FIG. 1.
Figure 3:
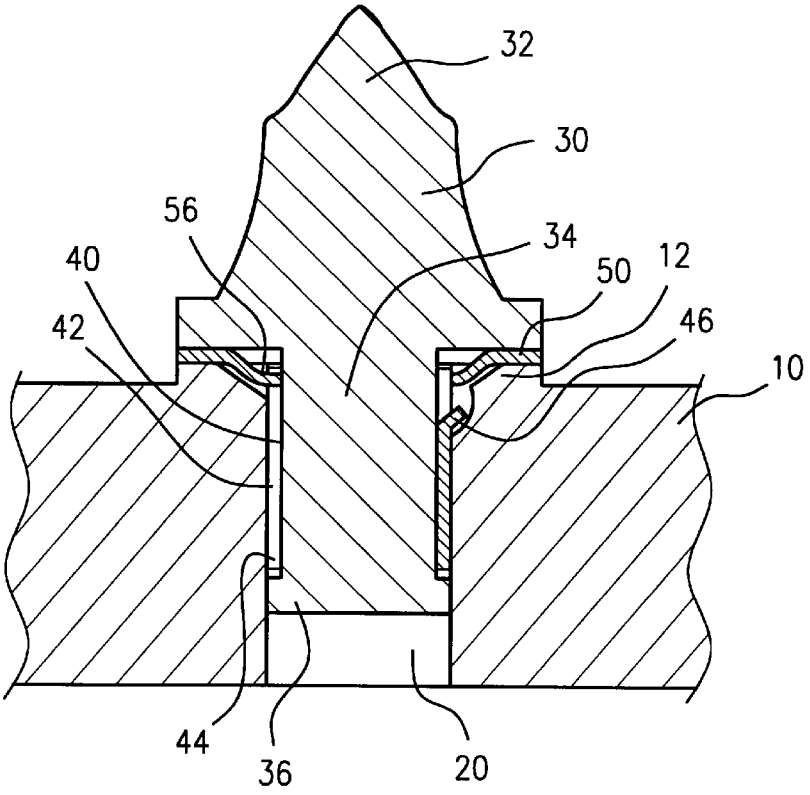
FIG. 3 is a cross-sectional view of the wear prevention device of FIG. 1 taken along line III—III.
Figure 4:
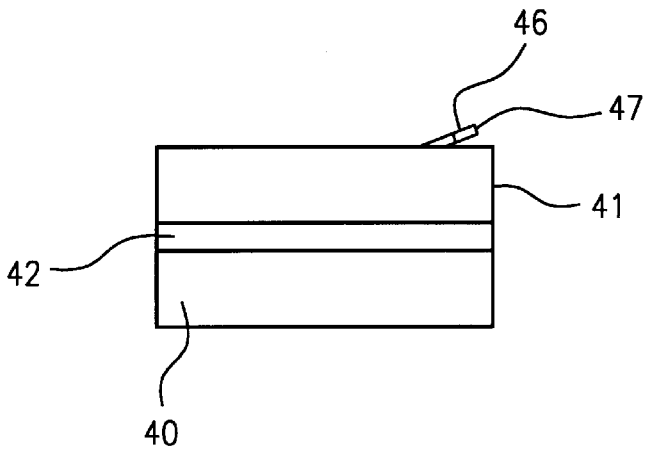
FIG. 4 is a view from the side of the retainer sleeve of FIG. 1.
Figure 5:
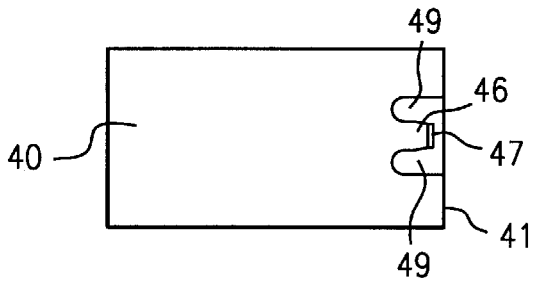
FIG. 5 is a view from the top of the retainer sleeve of FIG. 1.
Figure 6:
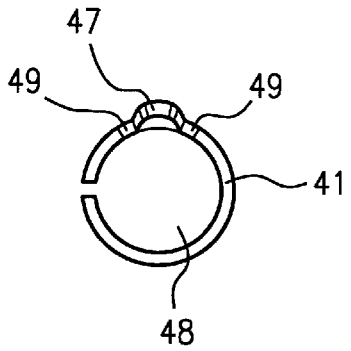
FIG. 6 is a view from one end of the retainer sleeve of FIG. 1.

FIGS. 1 and 3 show a cutting bit 30 having a cutting insert 32 positioned at one end, a substantially cylindrical cutting bit shank end 36 at the opposite end and a substantially cylindrical cutting bit shank 34 positioned therebetween. The shank end 36 has a larger diameter than shank 34. FIGS. 1 and 3 further show a substantially cylindrical sleeve 40 adapted to fit around cutting bit shank 34. Sleeve 40 includes a sleeve edge 41 and a sleeve slot 42. Sleeve slot 42 runs the entire length of sleeve 40 and is bounded on two sides by slot walls 44.

FIGS. 1 and 3 further show a substantially circular wear washer 50 having a washer beveled surface 52 sloping inwardly toward a washer opening 53. Opening 53 is bounded by washer interface 54. Located on washer interface 54 is a washer key 56, bounded on either side by washer cut-in portions 58. Washer key 56 is adapted so as to fit within slot 42 of sleeve 40 as sleeve 40 is placed within opening 53. By fitting key 56 within slot 42, friction wear on the sleeve 40, caused by the sleeve 40 coming into frictional contact with a bore 20 due to the rotation of the cutting bit 30, is reduced.

FIG. 1 further shows machine block 10 having a block face 11 and the bore 20. Block face 11 is adapted so as to receive wear washer 50 upon the block face surface. This may be accomplished through the inclusion of a boss 12 having a beveled surface 14 sloping inwardly toward bore 20. Bore 20 further includes and is substantially bounded by bore surface 22.

Now will be described the manner of use of the wear washer 50. As shown in FIGS. 1 and 3, the cutting bit shank 34 of the cutting bit 30 is placed within sleeve bore 48 of sleeve 40. Sleeve 40 is in turn positioned within opening 53 of wear washer 50. Sleeve 40 is to be so positioned within opening 53 such that key 56 slides up into slot 42. Sleeve 40 and shank 34 are then forced into machine block bore 20 of machine block 10. Shank end 36 prevents the cutting bit 30 from moving axially out of bore 20.

The outer circumference of sleeve 40 is slightly larger than the circumference of machine block bore 20. By forcing sleeve 40 into bore 20, slot walls 44 are forced toward one another, which may thereby pinch key 56 therebetween. This locks key 56 into slot 42, thus interlocking sleeve 40 with wear washer 50.

Next will be described another preferred embodiment of the present invention. Sleeve 40 may further include a key 46 having a tip 47 at an end and being bounded on either side by cutouts 49. Key 46 is located nearest sleeve edge 41. Key 46 further is bent outwardly away from sleeve bore 48.

Machine block bore surface 22 may further include a slot 16 having a surface 18. Alternatively, slot 16 may be included in boss beveled surface 14. Slot 16 is adapted to receive sleeve key 46.

In use, sleeve 40 is positioned within opening 53 such that key 56 fits within slot 42 and such that key 46 is received by slot 16. Through this arrangement, sleeve 40 is further prevented from any axial movement out of machine block bore 20 due to resistance caused by key 46 against slot 16. Furthermore, through this arrangement, sleeve 40 is interlocked with both wear washer 50 and machine block 10. This provides the enhanced benefit of diminishing even further the potential for frictional wear on the sleeve 40.

The above description and drawings are merely illustrative of preferred embodiments which achieve the objects, features and advantages of the present invention. It is not intended that the present invention be limited thereto. Any modification of the present invention which comes within the spirit and scope of the following claims is considered part of the present invention.

What is claimed and desired to be protected by Letters Patent of the United States is:

1. A wear prevention device comprising:

an annular wear washer adapted to be mounted on a machine block having a bore, said wear washer having an opening and a radially internally directed key;

an annular sleeve having a longitudinally directed slot, said sleeve adapted to surround a shank of a cutting bit, wherein said washer key is adapted to fit within said sleeve slot, thereby keying said washer to said sleeve;

a longitudinally directed slot on a surface of said bore, wherein said sleeve has a key adapted to fit within said bore slot, thereby keying said sleeve to said machine block.

2. A device as recited in claim 1 further comprising a boss including a centrally positioned opening having a longitudinally directed slot, said boss positioned on said machine block so that said boss slot is aligned with said bore slot, said washer mounted upon said boss and said sleeve positioned within said boss opening such that said sleeve key fits within said boss slot and said bore slot.

3. A method for preventing wear on a machine block comprising the steps of:

providing a machine block, said machine block including a bore with a bore surface;

locating a washer on said machine block, said washer having an opening and a radially inwardly directed key;

positioning a shank portion of a cutting bit within a sleeve, said sleeve having a longitudinally directed slot, said sleeve further having a key and said bore surface includes a longitudinally directed slot, wherein as said sleeve is placed within said washer and said bore, said sleeve is keyed to said machine block by said sleeve key fitting within said bore slot; and placing said shank and said sleeve within said washer opening and said bore such that said washer key fits within said sleeve slot.

4. A wear prevention device, comprising:

an annular wear washer adapted to be mounted on a machine block having a bore, said wear washer being interlocked in relation to said bore so as to be nonrotatable thereto;

an annular sleeve adapted to surround a shank of a cutting bit within said bore, wherein said wear washer has a washer locking member and said annular sleeve has a sleeve locking member, and wherein said washer locking member is adapted to engage said sleeve locking member, thereby interlocking said washer to said sleeve to prevent rotation relative to one another; and wherein said machine block has a slot on a surface of said bore and said sleeve has a second locking member adapted to engage said bore slot, thereby interlocking said sleeve to said machine block.

5. A wear prevention device, comprising:

an annular wear washer adapted to be mounted on a machine block having a bore, said wear washer being interlocked in relation to said bore so as to be nonrotatable thereto;

an annular sleeve adapted to surround a shank of a cutting bit within said bore, wherein said wear washer has a washer locking member and said annular sleeve has a sleeve locking member, and wherein said washer locking member is adapted to engage said sleeve locking member, thereby interlocking said washer to said sleeve to prevent rotation relative to one another;

wherein said washer locking member is a key, said sleeve locking member is a slot and said key is adapted to engage said slot; and wherein said machine block has a slot on a surface of said bore and said sleeve has a second locking member adapted to engage said bore slot, thereby interlocking said sleeve to said machine block and interlocking said washer indirectly through said sleeve to said machine block.

* * * * *